US010924871B2

(12) United States Patent
Meister

(10) Patent No.: US 10,924,871 B2
(45) Date of Patent: Feb. 16, 2021

(54) METHOD FOR THE IDENTIFICATION OF AN EARPIECE, HEARING AID SYSTEM AND EARPIECE SET

(71) Applicant: SIVANTOS PTE. LTD., Singapore (SG)

(72) Inventor: Bernd Meister, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/442,752

(22) Filed: Jun. 17, 2019

(65) Prior Publication Data

US 2019/0387329 A1 Dec. 19, 2019

(30) Foreign Application Priority Data

Jun. 15, 2018 (DE) ..... 10 2018 209 720

(51) Int. Cl.
*H04R 25/00* (2006.01)

(52) U.S. Cl.
CPC ..... *H04R 25/552* (2013.01); *H04R 25/356* (2013.01); *H04R 25/43* (2013.01); *H04R 25/30* (2013.01); *H04R 2225/41* (2013.01)

(58) Field of Classification Search
CPC .... H04R 25/552; H04R 25/356; H04R 25/43; H04R 25/30; H04R 2225/41
See application file for complete search history.

(56) References Cited

U.S. PATENT DOCUMENTS 8,433,072 B2 4/2013 Mueller et al.
8,605,913 B2 12/2013 Schwerdtner
8,855,323 B2 10/2014 Kroman
9,258,658 B2 2/2016 Jorgensen et al.
2003/0235311 A1 12/2003 Grancea et al.
2005/0031137 A1* 2/2005 Browning ..... H04R 9/00 381/96
2006/0093172 A1* 5/2006 Ludvigsen ..... H04R 25/552 381/315
2010/0067707 A1* 3/2010 Schwerdtner ..... H04R 25/552 381/23.1
2010/0111315 A1 5/2010 Kroman
(Continued)

FOREIGN PATENT DOCUMENTS

DE 102008047577 B3 8/2010
DE 102017209816 B3 7/2018
(Continued)

*Primary Examiner* — Sunita Joshi

(74) *Attorney, Agent, or Firm* — Laurence A. Greenberg; Werner H. Sterner; Ralph E. Locher

(57) ABSTRACT

A method for the identification of a receiver belonging to one of a plurality of receiver types in a hearing aid system includes supplying an electrical input signal to the receiver for sound output. The input signal is a primary signal, and a secondary signal that depends on the input signal is generated on the basis of the sound output. The secondary signal is captured by a sensor which generates an electrical sensor signal depending on the secondary signal. A phase measurement is furthermore carried out by determining a phase difference between the input signal and the sensor signal. The receiver is then identified by assigning the receiver to one of the plurality of receiver types on the basis of the phase difference. A corresponding hearing aid system and an receiver set are also provided.

17 Claims, 3 Drawing Sheets

(56) References Cited

U.S. PATENT DOCUMENTS

| | | | | |
|---|---|---|---|---|
| 2010/0272272 | A1* | 10/2010 | Muller | H04R 25/658 381/60 |
| 2014/0321682 | A1* | 10/2014 | Kofod-Hansen | H04R 25/305 381/315 |
| 2018/0359573 | A1 | 12/2018 | Meister et al. | |

FOREIGN PATENT DOCUMENTS

| | | | |
|---|---|---|---|
| EP | 2166781 | A1 | 3/2010 |
| EP | 2637423 | A1 | 9/2013 |
| WO | 2009006889 | A1 | 1/2009 |

* cited by examiner

METHOD FOR THE IDENTIFICATION OF AN EARPIECE, HEARING AID SYSTEM AND EARPIECE SET

CROSS-REFERENCE TO RELATED APPLICATION

This application claims the priority, under 35 U.S.C. § 119, of German Patent Application DE 10 2018 209 720.8, filed Jun. 15, 2018; the prior application is herewith incorporated by reference in its entirety.

BACKGROUND OF THE INVENTION

Field of the Invention

The invention relates to a method for the identification of a receiver, a hearing aid system and a receiver set.

A hearing aid system includes one or two hearing devices that are worn by a user in or at the ear. A hearing aid system with two hearing devices that are then worn in or at the ears on different sides of the head is also referred to as a binaural hearing aid system. A hearing device includes a receiver for sound output which, depending on the type of hearing device, is either inserted into the ear or is worn outside the ear. The sound signals are then passed into the ear through, for example, a sound tube. A binaural hearing aid system accordingly includes two receivers. Hearing device types are, for example, BTE, ITE or RIC hearing devices.

A hearing aid system in general serves for the output of sound signals, and often, in particular, for the improvement of the hearing capacity of the user. The user, typically, has a restricted hearing capacity and the hearing aid system is then generally used to amplify sound signals from the environment with the aim of compensating for a deficient hearing capacity. A particular hearing aid system in that case is usually adapted individually to the respective user and is adjusted in order to be appropriate for that user's individual hearing capacity and to compensate as optimally as possible for the individual restriction of the hearing capacity. The hearing capacity of the user is frequently determined specifically for that purpose in the course of an adaptation, and the hearing aid system is then adjusted appropriately. That may differ between the two ears. In general, however, a hearing aid system can also be a receiver set.

An important component of a hearing aid system is the receiver, which is used for sound output and which is available in a large number of variants in systems with an external or modular hearing aid unit. Depending on the hearing capacity, a correspondingly suitable receiver is then selected and used in the hearing aid system. Different receivers vary, for example, in the power class, i.e. in the maximum possible power of the output sound signal and the maximum possible amplification that can be achieved when the hearing aid system is operating. If hearing loss is relatively marked, a receiver of a higher power class is then to be chosen in order to be able to compensate appropriately for the hearing loss. The hearing aid system is usually parameterized in such a way that its transfer function is adapted to the connected receiver.

The fact that, in principle, different receivers can be used in one hearing aid system, or that the two sides are adjusted differently, or both, and that there is therefore a risk of confusion, is problematic. The hearing aid system is typically constructed in such a way that a variety of receivers of different receiver types can be connected as needed. If a plurality of different receiver types are present, then when assembling the hearing aid system, i.e. when connecting a receiver to the hearing aid system, it is also necessary to ensure that the correct receiver type is also used. If a receiver set with receivers of different power classes is available, and a receiver of a particular power class should be used, there is a risk that a receiver of the wrong power class is accidentally picked up and inserted. Even when, for example, cleaning a hearing aid system, there is a risk that it is first dismantled into a plurality of parts for cleaning, and then incorrectly assembled. That is particularly problematic in the case of binaural hearing aid systems since in that case, in the nature of the case, two receivers are present which, due to a different hearing capacity on the two sides, can accordingly differ, i.e. can belong to different receiver types. If the two receivers are accidentally interchanged, the receiver intended for the left-hand side is used on the right-hand side, and vice versa. In general, the use of an incorrect receiver results in a significant safety risk for the user, in particular when an excessively high power class is accidentally used.

It is proposed in U.S. Pat. No. 8,433,072 B2 that to distinguish between receivers with different properties, the electrical resistance of an receiver is used and measured as a characteristic parameter. It is also proposed that a receiver is given an identification mark, for example an RFID tag, and that the tag is then read in order to determine the properties of the receiver.

SUMMARY OF THE INVENTION

It is accordingly an object of the invention to provide a method for the identification of a receiver, a hearing aid system and a receiver set, which overcome the hereinaforementioned disadvantages of the heretofore-known methods and devices of this general type, in which different receiver types should, in general, be recognized as reliably as possible and, in particular, in which the risk of harm to the user through the insertion and operation of an incorrect receiver should be reduced.

With the foregoing and other objects in view there is provided, in accordance with the invention, a method for the identification of a receiver of a hearing aid system, wherein the receiver belongs to one of a plurality of receiver types, in which an electrical input signal is supplied to the receiver for sound output, the input signal is a primary signal, and a secondary signal that depends on the input signal is generated on the basis of the sound output, the secondary signal is captured by a sensor which, depending on the secondary signal, generates an electrical sensor signal, a phase measurement is carried out in that a phase difference between the input signal and the sensor signal is determined, and the receiver is identified in that the receiver is assigned to one of the plurality of receiver types on the basis of the phase difference.

The explanations given with respect to the method also in this case apply analogously for the hearing aid system as well as for the receiver set, and vice versa.

The method serves for the identification of a receiver of a binaural hearing aid system and is expediently also used for this purpose. The method preferably serves for the identification of the receiver in the hearing aid system, i.e. while the receiver is joined to the hearing aid system, i.e. is connected to it. The identification is thus carried out, so to speak, in situ, i.e. in the course of intended use, and preferably by the hearing aid system itself and precisely when not decoupled from the hearing aid system. The hearing aid system in particular includes a control unit which is constructed in such a way that it carries out the method. A variant is, however, also suitable in which the receiver is, alternatively or in addition, identified outside the hearing aid system and independently thereof, for example in a separate test process at audiologists. The control unit is, alternatively or in addition, integrated into an external device, for example in a smart phone or a computer.

The receiver belongs to one of a plurality of in particular different receiver types. The receiver is now identified in that it is assigned to one of the plurality of receiver types. In connection with a receiver, the terms "identification" and "identify" are understood to mean that it is not just whether an receiver is connected that is recognized, but the type of receiver that is connected is recognized. In other words, the receiver type is concretely determined, and not just the presence of any receiver, so that various, that is to say at least two, different receiver types can be distinguished from one another and indeed are distinguished.

An electrical input signal, referred to for short simply as the input signal, is supplied to the receiver for sound output. The receiver converts the input signal into an acoustic sound signal, known for short simply as the sound signal, and outputs it. A sound output thus occurs. The input signal is, in general, a primary signal, and a secondary signal that depends on the input signal is now generated on the basis of the sound output. The secondary signal is not necessarily the sound signal itself. A plurality of different signals may be considered as the secondary signal. What is in particular important is that the secondary signal is causally associated with the input signal.

The secondary signal is then captured by a sensor which, depending on the secondary signal, generates an electrical sensor signal, known for short simply as the sensor signal. The secondary signal is thus measured by the sensor. The sensor signal thus depends on the input signal. The dependency of the sensor signal on the input signal is determined in particular by a transfer function which does not necessarily have to be known. The transfer function in particular describes the change that the input signal undergoes along a transfer path in the conversion into the sensor signal.

A phase measurement is furthermore carried out in that a phase difference between the input signal and the sensor signal is determined. The phase measurement is thus, in particular, a comparative electrical measurement in which two electrical signals, namely the input signal and the sensor signal, are compared to one another and their phase with respect to one another is determined. The receiver is then identified in that it is assigned to one of the plurality of receiver types on the basis of the phase difference.

In the method, the receiver is connected to a receiver connection, preferably a receiver connection of the hearing aid system. The input signal is provided to the receiver through the receiver connection. The invention is in particular based on the concept of identifying a receiver in that receivers of different receiver types are constructed in such a way that they engender different phase responses, and thereby phase differences, at the same receiver connection and for the same input signal, and then of recognizing these phase differences in order to perform an appropriate assignment of the receiver to one of the receiver types in a simple and reliable manner. Put briefly, the receivers of different receiver types differ in that in the phase measurement they yield different phase differences. Different receivers of the same receiver type, on the other hand, expediently also yield the same phase difference. An receiver set according to the invention therefore includes at least two receivers that belong to different receiver types and that are constructed in such a way that through the phase measurement described they can be correspondingly distinguished.

In order to generate the phase difference for the purpose of identification of the receiver, the receiver and the sensor are advantageously so constructed that in their interaction as a whole they generate the phase difference. It is in the nature of the system that a so-called transfer phase difference has possibly already arisen due to the transfer function between the input signal and the sensor signal. For the purposes of identifying the receiver, however, in addition to the transfer phase difference, an identification phase difference, referred to for short as the ID phase difference, is now added depending on the receiver type. All told, different phase differences then also result for different receiver types, in particular with a transfer path that is constant or only slightly modified. Thus, an additional phase is impressed along the transfer path for identification, that is to say an identification phase or ID phase, which is then present in the sensor signal in addition to a possible transfer phase difference resulting from the transfer path itself. The transfer phase difference is then appropriately considered as an offset in the phase measurement, and is preferably for this purpose for example estimated or measured in advance.

A central concept of the invention accordingly resides in particular in configuring a hearing aid system or a receiver for such a system, or both, in such a way that a receiver of an incorrect receiver type that is not to be used yields a recognizably deviating phase difference during the phase measurement, that is to say an actual phase difference that differs recognizably from an expected phase difference that would be yielded by a receiver of a correct receiver type. An important aspect in this case is the phase measurement which can be realized in a particularly simple manner and allows a particularly compact construction. A special advantage of the phase measurement is, in particular, that special or additional components such as resistors or RFID tags are not in the first place necessary in order to identify the receiver. Accordingly, a sensor that in any case is already installed in the hearing aid system and which will then also be used for other purposes, in particular during operation of the hearing aid system for its intended purpose, is preferably used as the sensor. A further special advantage is, in particular, that the receiver initially only requires two signal contacts for connection to the hearing aid system, and a third contact, which is constructed as an identification contact, and in particular for sole use for identification of the receiver, is not necessary. Such a third contact is therefore preferably omitted, and correspondingly installation space is saved.

Which type of receiver generates which phase difference is thus, in particular, already known when identifying the receiver. An assignment rule, in particular an assignment table, is expediently stored for this purpose in a memory of, in particular, the hearing aid system. The assignment rule assigns a specific phase difference to each receiver type, so that then during the phase measurement the receiver type can be determined by using the assignment table, and expediently also is determined. The memory is, in particular, part of the control unit.

The method can in particular be advantageously used in order to establish whether, on a respective side of a binaural hearing aid system, an receiver that belongs to a receiver type that is also intended for this side is also connected. In a particularly preferred embodiment, therefore, the hearing aid system is binaural, and a first of the plurality of receiver types is a left-hand receiver which is provided for use on the left-hand side of the hearing aid system, and a second of the plurality of receiver types is a right-hand receiver which is provided for use on the right-hand side of the hearing aid system. The hearing aid system thus includes a left-hand hearing device and a right-hand hearing device. The left-hand hearing device serves to supply the left ear of a user and when used as intended is worn on the left-hand side; the right-hand hearing device, similarly, serves to supply the right ear of the user, and when used as intended is worn on the right-hand side. An exchange is not provided and should indeed be prevented, since it may be the case that the user has different hearing capacities on the two sides and that therefore the two hearing devices are each expediently adjusted individually to supply the corresponding side. A side recognition is then carried out in the context of the method in that the receiver is identified as a left-hand receiver or as a right-hand receiver on the basis of the phase difference. The phase measurement is thus preferably used for side recognition and in this case, in particular, only for distinguishing between precisely two receiver types. The two receiver types then preferably generate phase differences that differ by 180° and thus are particularly easy to discriminate, i.e. are distinguishable. A user is then advantageously protected by the side recognition from incorrectly using the two receivers of a binaural hearing aid system in an interchanged manner.

A type of embodiment in which more than two receiver types are distinguished by the phase measurement is, however, also in principle possible and suitable, in that more than two different phase differences are correspondingly generated by the receiver types, and that these are recognized.

The generation of different phase differences by receivers of different receiver types can be realized in a variety of ways, as is explained in more detail below.

In one suitable embodiment, the receiver includes two signal contacts, and the receiver can be connected, and advantageously also is connected, with reverse-polarity protection by the signal contacts to a hearing device of the hearing aid system. The receiver, and in particular the two signal contacts, are thus constructed with reverse-polarity protection. A first receiver type and a second receiver type of the plurality of receiver types now preferably differ from one another in that they are constructed with mutually opposed reverse-polarity protection, so that the two phase differences that are generated by a receiver of the first receiver type and by a receiver of the second receiver type differ by 180°. The signal contacts of the two receiver types are thus constructed with mutually opposed reverse-polarity protection. The one of the two receiver types thus has the result that an additional phase of 180° is impressed during the conversion of the input signal to the sensor signal, so that a corresponding phase difference results relative to the other receiver type. In one appropriate embodiment, the first receiver type is provided for the left-hand side of a binaural hearing aid system, and the second receiver type for the right-hand side. If now one of the two receivers is incorrectly connected, in reverse, to the other side, then a phase difference will be measured in the course of a side recognition that differs by 180° from an expected phase difference, wherein the expected phase difference is the phase difference that would be generated by the other receiver.

In detail, this concept is preferably realized with two receiver types constructed with mutually opposed reverse-polarity protection as follows: the receiver has a signal interface for the connection to a hearing device of the hearing aid system. The signal interface includes a first signal contact and a second signal contact. The signal contacts in this case are each associated in particular with a specific pole of the receiver; the first signal contact is then always a positive pole and the second signal contact is always a negative pole. The hearing device includes in particular an appropriately complementary hearing device signal interface that has two poles for the connection of the signal contacts, one pole for each signal contact. The signal interface is now constructed with reverse-polarity protection in such a way that one of the signal contacts can only be connected to a first pole of the hearing device, and the other signal contact only to a second pole of the hearing device, and precisely not the other way around. This is, for example, realized through different geometries of the individual signal contacts and poles or through an appropriate plug contour. A first receiver type and a second receiver type of the plurality of receiver types then differ from one another in particular in that, in the case of the first receiver type, the first signal contact can only be connected to the first pole and the second signal contact only to the second pole, whereas the second receiver type is constructed with polarity reversal in comparison with the first receiver type in such a way that in this case, conversely, the first signal contact can only be connected to the second pole and the second signal contact only to the first pole. Thus in the case of the one receiver type the positive pole is also connected to a positive pole at the hearing device and correspondingly, a negative pole at the receiver to a negative pole at the hearing device, and in the case of the other receiver type, conversely, a respective negative pole is connected to a positive pole. In general, it is advantageously achieved in this way that the two phase differences that are generated by the two receiver types differ by 180° if these are connected on the same side, i.e. to the same hearing device signal interface.

In a first appropriate variant, the electrical input signal is supplied to the receiver through the signal contacts, and the sensor is disposed outside the receiver and independently of the receiver. The polarity reversal is thus realized in that the transmission of the input signal to the receiver is configured with polarity reversal, so that it is then in the nature of the system that the secondary signal that is generated by a receiver of the first receiver type has an opposite arithmetic sign in comparison with the secondary signal that is generated by a receiver of the second receiver type. The phase difference for identification of the receiver is thus, in particular, generated during the transfer of the input signal to the receiver, i.e. the ID phase is impressed at the moment of transfer of the input signal to the receiver, and thus at the beginning of the transfer path. The sensor then generates an appropriate sensor signal according to the secondary signal. In this variant, the receivers themselves are thus configured with mutually opposed polarity reversal.

In order to achieve an optimum hearing comfort, in particular in the case of the first variant in a normal hearing operation, hearing operation for short, the input signal is preferably supplied on the one side to the receiver with a reversed arithmetic sign, so that the secondary signals on the two sides are then, precisely, no longer opposed, but in particular have the same phase. In order to identify the receiver, however, the original input signal is then expediently used, in order to be able to generate appropriately opposite-phase secondary signals, so that the two receiver types can then be distinguished and also are distinguished.

In a second suitable variant, in contrast, the receivers are not themselves of reverse polarity with respect to the input signal, but the sensors on the two sides of the hearing aid system. The sensor is in this case expediently integrated into the receiver and permanently connected to it, so that the sensor and the receiver together in particular form an inseparable assembly. This applies correspondingly to both sides of a binaural hearing aid system, wherein, again quite generally, a binaural hearing aid system in particular includes two sensors, namely one for each of the two receivers. In the second variant, the sensor signal is now transferred through the signal contacts, not the input signal. The above explanations related to the first variant also analogously apply, however, to the second variant, in which now the input signals as well as the secondary signals are fundamentally of the same phase but wherein however the sensor signals are of opposite phase. The phase difference for identification of the receiver is thus generated at the generation of the sensor signal, or more precisely at the transfer of the sensor signal to the control unit, i.e. the ID phase is impressed on the sensor signal, and thus at the end of the transfer path. This in particular offers the advantage that the input signal does not have to be manipulated for normal hearing operation.

In the second variant, the receiver includes in particular two signal interfaces, a reverse-polarity signal interface for the sensor signal and a further, non-reversed-polarity signal interface for the input signal. The receiver of the second variant, on the other hand, includes only one signal interface, namely for the input signal, and otherwise no further signal interfaces.

In the second variant, specifically, the sensor is connected to the receiver in such a way that a disconnection is not possible when handled properly. The sensor is thus permanently as well as uniquely associated with the receiver. The sensor is thus, in particular, constructed as a component of the receiver. It is in this way ensured that the correct sensor is also always connected to the associated receiver, since an identification of the receiver is not possible only on the basis of the receiver itself. The sensor, or put more precisely its special polarity reversal, indeed serves for this purpose. In order to integrate the sensor into the receiver, the sensor is fastened to the receiver, for example being glued to it, cast into a housing of the receiver, or being a component of the receiver itself.

A plurality of different concepts are, in principle, suitable for the phase measurement. An important point in this case is, in particular, that a sensor signal is generated which is connected to the input signal through a transfer function, and that when generating the sensor signal from the input signal an additional phase difference is added, that is an additional phase is impressed, which phase difference or phase is then used for identification of the receiver. This phase is therefore referred to as the ID phase, as already described above. All kinds of secondary signal, and highly varied sensors, are however fundamentally suitable for their measurement. Some preferred combinations of secondary signal and sensor are explained in detail below. The cited variants can also be combined with one another.

In one preferred embodiment, the secondary signal is a sound signal which is generated by the receiver during the sound output, and the sensor is a microphone which picks up the sound signal. A microphone of the hearing aid system is advantageously used as the sensor, in particular a microphone that is a part of a hearing device of the hearing aid system and that is used during hearing operation to pick up noises from the environment in order to subsequently amplify them and to output them through the receiver of the hearing device. For example, a microphone that is worn by the user in the auditory canal in the course of intended use, in particular a structure-borne sound microphone, or alternatively an additional microphone, is also, however, suitable. The secondary signal is, in particular, a sound signal that is generated in any case for output to the user. This is usually further modified by reflections, natural vibration modes and bends in the auditory canal of the user before it is picked up by the sensor.

In a further preferred embodiment, the secondary signal is a magnetic field which is generated by the receiver during the sound output, and the sensor is a magnetic field sensor which measures the magnetic field. This variant is based on the consideration that during the sound output a receiver, in principle, generates a magnetic field that is dependent on the electrical input signal, so that an additional phase difference is particularly effectively recognizable during a comparison with the input signal. The sensor is, appropriately, a Hall sensor, a coil or a telephone coil, also referred to as a T-coil, which in any case is already present in a hearing device of the hearing aid system.

In a further preferred embodiment, the secondary signal is a vibration which is generated, in particular at least indirectly, by the receiver during the sound output, and the sensor is a vibration or acceleration sensor which picks up the vibration. A vibration sensor differs from a microphone in particular in that a vibration sensor is not directly excited by a sound signal, but rather measures a vibration, i.e. a mechanical acceleration, in particular of the surrounding environment, or of the surrounding components, or both. The sensor, for example, then measures a vibration of the receiver, or, more precisely put, of a housing of the receiver, during the sound output. In one suitable embodiment, a vibration or acceleration sensor includes a test mass on a floating mount which mass is accordingly excited by sound or vibration or by both, so that the vibration or acceleration sensor then generates a sensor signal that depends on the input signal.

It should in particular be borne in mind that an appropriately suitable sampling rate is used for the sensor for the most secure measurement possible of the phase difference. The input signal usually has a frequency spectrum in the range that is audible for those with normal hearing from, in particular, 20 Hz up to 20 kHz, so that the secondary signal also correspondingly lies in this frequency range. Expediently, therefore, the sampling rate for the sensor is selected in such a way that the sensor signal also represents such frequencies. An acceleration sensor in particular is typically operated when used as intended with a sampling rate of merely a few measured values per second, i.e. significantly below 20 Hz. A sampling rate of between 40 Hz and 40 kHz is then expediently generally chosen for the sensor for measurement of the secondary signal.

In principle, any signal can be used as the input signal, including in particular any sound signal picked up from the environment and converted during hearing operation or, alternatively or in addition, an electrical audio signal. In order, however, to identify the receiver as early as possible and, advantageously, outside of regular hearing operation, the electrical input signal in an expedient embodiment is a start signal which is played when switching on, i.e. when operation of the hearing aid system begins. An identification of the receiver thus takes place even before an actual hearing operation. The start signal is preferably a start melody which is played when the hearing aid system is switched on and for acoustic indication of the commencement of operation.

Alternatively or in addition, the receiver is advantageously identified in the course of an open-loop gain measurement of the hearing aid system. This open-loop gain measurement is also referred to as calibration operating mode and, put more precisely, is a calibration operating mode for calibration of a maximum amplification of the hearing device, which usually depends on the environmental conditions that are actually present at the time, and are possibly changing. The hearing aid system in this case thus includes an amplification control which is calibrated in the calibration operating mode in that a test signal is used as the input signal, whereby a calibration signal is generated in order to adjust the maximum amplification of the hearing aid system. The calibration signal is, in particular, a microphone signal; the test signal is thus output and recaptured in order to characterize the environment. The calibration signal is then in particular used in combination with the test signal to determine, in particular to estimate, the transfer function from the receiver of the hearing aid system to the eardrum of the user and, depending on that, to adjust the maximum amplification. The calibration signal is now advantageously used concurrently as a sensor signal, i.e. the calibration signal is the sensor signal. To that extent this embodiment is similar to the embodiment described further above, with the sound signal as the secondary signal and the microphone as the sensor. The identification of the receiver then takes place in this case advantageously in parallel with the open-loop gain measurement, so that the effort, in terms of apparatus and control technology, to identify the receiver is minimal, since the same calibration signal is used for both purposes. The measurement described is, moreover, not restricted to a special calibration operating mode, but in an advantageous embodiment is performed during ongoing operation, in particular in normal operation. The measurement is preferably performed adaptively. The phase is in this case then advantageously determined continuously, i.e. repeatedly, while the hearing aid system is running. The sensor is in particular connected for this purpose to an appropriate signal processing block which estimates the transfer function. The signal processing block is preferably a part of the control unit.

Preferably, in addition to the identification of the receiver by the phase measurement, a power class of the receiver is also determined by an amplitude measurement, wherein the amplitude measurement is preferably carried out with the sensor. The amplitude measurement is, in particular, a measurement of an amplitude frequency response. The receiver thus has a power class that is determined through an additional amplitude measurement which is carried out, in particular, simultaneously with the phase measurement. The power class is appropriately determined through a transfer function of the receiver, i.e. in particular through an amplitude frequency response which is assigned to a particular power class. The power class of the receiver is then thereby determined through measurement of the amplitude, i.e. through the amplitude measurement.

Alternatively or in addition, in one suitable embodiment, in addition to identification of the receiver by the phase measurement, a power class of the receiver is also determined by an impedance measurement. The receiver thus has a power class that is determined through an additional impedance measurement which is carried out, in particular, simultaneously with the phase measurement. The power class is appropriately defined by an electrical resistance of the receiver, i.e. an electrical resistor is integrated into the receiver which has a specific resistance value which is assigned to a specific power class. The power class of the receiver is then thereby determined through measurement of the resistance.

An embodiment in which the phase measurement is used for side recognition, so that a receiver is then assigned on one hand to a power class by an amplitude or resistance measurement and in addition on the other hand to a side of the hearing aid system by a phase measurement, is particularly advantageous in the power class recognition as described above. The receiver is then therefore, so to speak, identified in two dimensions, namely once in terms of the power class and once in terms of the side. An receiver type is thus to that extent characterized by two parameters, namely by a first parameter, the "power class," and a second parameter, the "side."

A particular advantage in the determination of the power class is in particular that with the same measurement, also referred to as measurement routine, the phase difference is also measurable at the same time, i.e. the phase measurement takes place as a part in general of the measurement routine, so that the power class and the side can be determined, and also expediently are determined, simultaneously with a single measurement.

The phase measurement is preferably carried out at a frequency of at most 500 Hz. This is based in particular on the consideration that the phase difference can be more easily determined at low frequencies than at high frequencies, since signals at high frequencies are more subject to interference. Thus, at higher frequencies interfering influences caused, for example, by the individual geometry of the ear of the user, or the length chosen for a sound tube of a hearing device of the hearing aid system, become increasingly evident. In principle, the entire acoustic frequency range comes into consideration for measurement, wherein, however, low frequencies, i.e. frequencies of at most 500 Hz, enable particularly reliable measurements. The phase measurement is preferably however carried out at least at a frequency of 20 Hz. The sampling rate of the sensor is expediently adjusted to the frequency, and preferably corresponds to at least twice the frequency.

With the objects of the invention in view, there is also provided a hearing aid system according to the invention which is constructed to carry out the method described above, and comprises in particular a control unit for this purpose. In one suitable embodiment the control unit is integrated into a hearing device of the hearing aid system. In a variant that is also suitable, the control unit is constructed as a separate part of the hearing aid system.

With the objects of the invention in view, there is concomitantly provided a receiver configured to be used in the method according to the invention.

Other features which are considered as characteristic for the invention are set forth in the appended claims.

Although the invention is illustrated and described herein as embodied in a method for the identification of a receiver, a hearing aid system and an receiver set, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
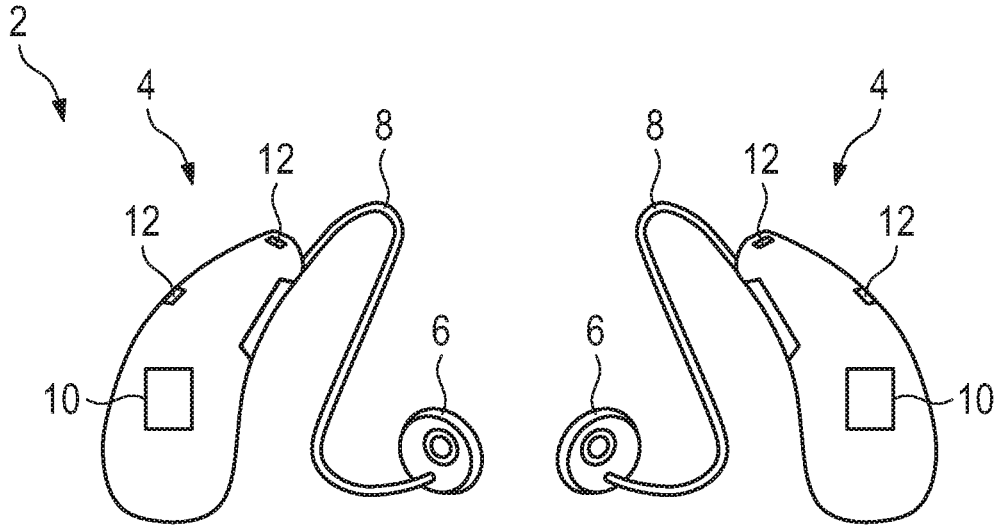
FIG. 1 is a diagrammatic, plan view of a binaural hearing aid system.

Referring now to the figures of the drawings in detail and first, particularly, to FIG. 1 thereof, there is seen a binaural hearing aid system 2 with one or two hearing devices 4, each of which is worn by a user in or at the ear. The following explanations are, however, also analogously applicable to a hearing aid system 2 with only one hearing device 4. In the exemplary embodiment shown, a respective hearing device 4 includes a receiver 6 for sound output which, depending on the hearing device type, is either inserted into the ear or is worn outside the ear. In the present case a so-called RIC hearing device is shown, only by way of example, in which the receiver 6 is worn in the ear and is connected to the rest of the hearing device 4 through an electrical connection 8.

The hearing aid system 2 illustrated serves generally for the amplification of sound signals from the environment with the aim of compensating for a deficient hearing capacity of the user. For this purpose, the hearing aid system 2 is adapted individually to the user and is adjusted in order to be appropriate for that user's individual hearing capacity and to compensate for the individual restriction of the hearing capacity. In a variant, not shown, the hearing aid system 2 is in general a receiver set.

The receiver 6, which serves for sound output and is available in a wide range of variants, is an important component of a hearing aid system 2. Depending on the hearing capacity, a suitable receiver 6 is selected and used in the hearing aid system 2. The hearing aid system 2 is now so constructed that the risk of a confusion of the receiver 6, i.e. the risk that a receiver 6 of an receiver type that is not intended for the user is incorrectly employed, is reduced. A method by which the receiver 6 is identified, i.e. assigned to one of a plurality of receiver types, is carried out for this purpose. The method is carried out in the present case by a control unit 10 which is a part of the hearing aid system 2 and is housed in one of the hearing devices 4.

Figure 2:
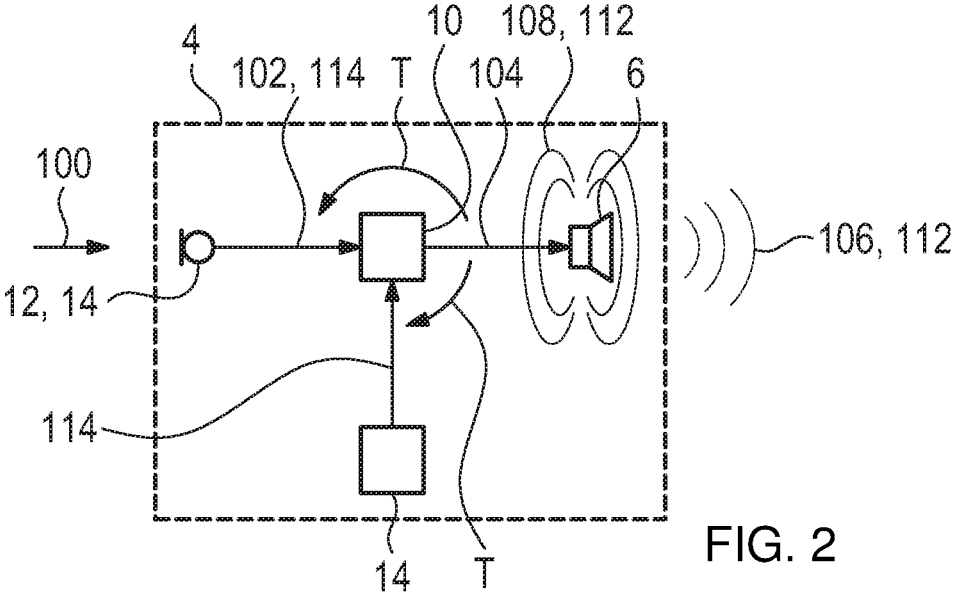
FIG. 2 is a schematic illustration of the hearing aid system of FIG. 1.

The method is explained in more detail with reference to FIG. 2, in which one of the hearing devices 4 of FIG. 1 is illustrated in a greatly schematic form as a circuit diagram. Fundamentally, the hearing aid system 2 is in the first place so constructed that a microphone 12 picks up sound signals 100 from the environment and converts them into a microphone signal 102. This microphone signal is passed on to the control unit 10 and amplified there. The control unit 10 thus generates an amplified microphone signal which is an electrical input signal 104 that is passed to the receiver 6 for output. The receiver 6 converts the input signal 104 in the course of a sound output into a sound signal 106 which is output to the user. It is the nature of the present case that the receiver 6 in this case also generates a magnetic field 108. The sound signal 106 and the magnetic field 108 thus depend on the input signal 104 which is also referred to as the primary signal 110. The sound signal 106 as well as the magnetic field 108 are therefore also each referred to as a secondary signal 112. Other secondary signals 112 which are not shown are, for example, a vibration or an acceleration generated by the sound output.

The method is now used for identification of the receiver 6 which belongs to one of a plurality of different receiver types. At least one of the secondary signals 112 is now captured by a sensor 14 which, depending on the secondary signal 112, generates an electrical sensor signal 114. The dependency of the sensor signal 114 on the input signal 112 is determined in particular by a transfer function T, which does not necessarily have to be known, and which describes the change that the input signal 104 undergoes along a transfer path in the conversion into the sensor signal 114. Two transfer functions T accordingly result in FIG. 2 for the two transfer paths indicated by arrows, namely once from the receiver 6 to the sensor 14 and once from the receiver 6 to the microphone 12 which can also be used as a sensor 14. A phase measurement is furthermore carried out in the present case by the control unit 10, in that a phase difference between the input signal 104 and the sensor signal 114 is determined. The receiver 6 is then assigned to one of the plurality of receiver types, and thereby identified, on the basis of the phase difference.

The receiver 6 is connected to a receiver connection 16 of the hearing aid system 2, and the input signal 104 is passed to the receiver 6 through the receiver connection 16. The receivers 6 of different receiver types are now so constructed that they engender different phase differences at the same receiver connection 16 and for the same input signal 104. Different phase differences thus result in the phase measurement for different receiver types. Different receivers 6 of the same receiver type, on the other hand, also yield the same phase difference. It is in the nature of the system that a so-called transfer phase difference has possibly already arisen due to the transfer function T between the input signal 104 and the sensor signal 114. For the purposes of identifying the receiver 6, in addition to the transfer phase difference, an identification phase difference, referred to for short as the ID phase difference, is now added depending on the receiver type. All told, different phase differences then also result for different receiver types with transfer paths that are constant. Thus, along the transfer path T an additional phase is impressed for identification, that is to say an identification phase or ID phase, which is then present in the sensor signal 114 in addition to a possible transfer phase difference resulting from the transfer path T itself. In general, the ID phase can be impressed at different locations along the transfer path.

A variant in which the secondary signal 112 is a sound signal 106 which is generated by the receiver 6 during the sound output is shown in FIG. 1. The sensor 14 in this case is the microphone 12 which serves during hearing operation to pick up noises from the environment in order to then amplify them and output them through the receiver 6 of the hearing device 4. Alternatively, another microphone is used.

A variant in which the secondary signal 112 is a magnetic field 108 which is generated by the receiver 6 during the sound output is also shown in FIG. 1. The sensor 14 is a magnetic field sensor which measures the magnetic field 108. The sensor 14 is, for example, a Hall sensor, a coil or a telephone coil of the hearing device 4, also referred to as a T-coil.

A further variant in which the secondary signal 112 is a vibration which is generated, in particular at least indirectly, by the receiver 6 during the sound output, wherein the sensor 14 is then a vibration sensor which picks up the vibration, is not shown. A variant in which the secondary signal 112 is an acceleration which is generated, at least indirectly, by the sound output, wherein the sensor 14 is then an acceleration sensor that measures the acceleration, is also not shown.

These variants, both shown and not shown, can also be applied individually or combined in any desired manner.

The method is used in the present case to establish whether, on a respective side of the binaural hearing aid system 2, a receiver 6 that belongs to a receiver type that is also intended for use on this side is also connected. A first of the plurality of receiver types is then a left-hand receiver which is provided for use on the left-hand side of the hearing aid system 2, and a second of the plurality of receiver types is a right-hand receiver which is provided for use on the right-hand side of the hearing aid system 2. A side recognition is then carried out in the context of the method in that the receiver 6 is identified as a left-hand receiver or as a right-hand receiver on the basis of the phase difference.

Figure 3A:
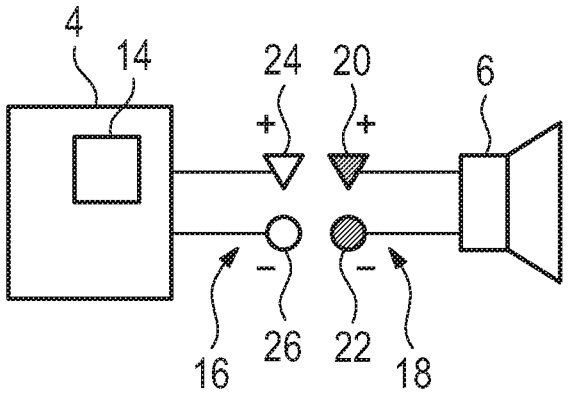
FIGS. 3A and 3B are schematic illustrations of a first variant of a hearing aid system.
Figure 3B:
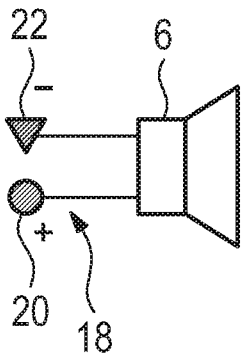

The way in which different phase differences can be generated by receivers 6 of different receiver types is illustrated in FIGS. 3A, 3B, 4A, 4B and 5A, 5B. FIGS. 3A and 3B in this case show a first variant, FIGS. 4A and 4B a second variant, and FIGS. 5A and 5B a third variant. In all variants the receiver 6 can be connected with reverse-polarity protection to a hearing device 4 of the hearing aid system 2, and is thus constructed with reverse-polarity protection. The first receiver type, shown respectively in FIGS. 3A, 4A and 5A, and the second receiver type, shown respectively in FIGS. 3B, 4B and 5B, now differ from one another in that they are constructed with mutually opposed reverse-polarity protection, so that the two phase differences that are generated by an receiver 6 of the first receiver type and by a receiver 6 of the second receiver type differ by 180°. The one of the two receiver types thus has the result that an additional phase of 180° is impressed during the conversion of the input signal 104 to the sensor signal 114, so that a corresponding phase difference results relative to the other receiver type. In the present case, merely by way of example, the first receiver type is provided for the left-hand side of the binaural hearing aid system 2, and the second receiver type for the right-hand side. If now one of the two receivers 6 is incorrectly connected, in reverse, to the other side, then a phase difference will be measured in the course of a side recognition that differs by 180° from an expected phase difference, wherein the expected phase difference is the phase difference that would be generated by the other receiver 6.

In the illustrated exemplary embodiments this concept is realized by way of example as follows using two receiver types constructed with mutually opposed reverse-polarity protection: the receiver 6 includes a signal interface 18 for connection to one of the hearing devices 4, or more precisely to the receiver connection 16, which is thus an accordingly complementary hearing device signal interface. The signal interface 18 includes a first signal contact 20 and a second signal contact 22. The hearing device 4, or more precisely the receiver connection 16, now includes two poles 24, 26 for connection of the signal contacts 20, 22. The signal interface 18 is now constructed with reverse-polarity protection in such a way that one of the signal contacts 20, 22 can only be connected to a first pole 24 of the hearing device, and the other of the signal contacts 20, 22 only to a second pole 26, and precisely not the other way around. This is for example realized, as shown in FIGS. 3A, 3B, 4A, 4B, 5A, 5B, through different geometries of the individual signal contacts 20, 22 and poles 24, 26. The first receiver type and the second receiver type then differ from one another in that, in the case of the first receiver type, the first signal contact 20 can only be connected to the first pole 24 and the second signal contact 22 only to the second pole 26, whereas the second receiver type is constructed with polarity reversal in comparison with the first receiver type in such a way that in this case, conversely, the first signal contact 20 can only be connected to the second pole 26 and the second signal contact 22 only to the first pole 24. It is achieved in this way that the two phase differences that are generated by the two receiver types differ by 180° if these are connected on the same side, i.e. to the same hearing device signal interface 18.

Figure 4A:
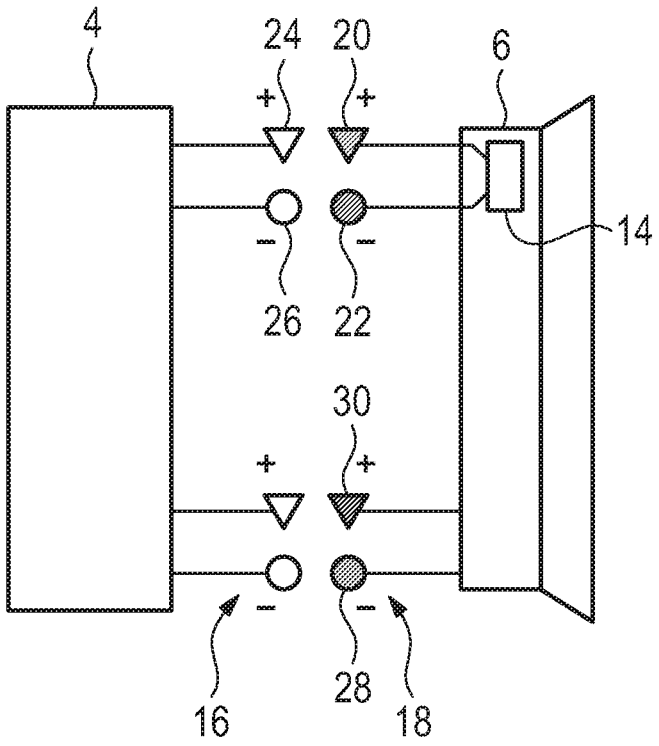
FIGS. 4A and 4B are schematic illustrations of a second variant of a hearing aid system.
Figure 4B:
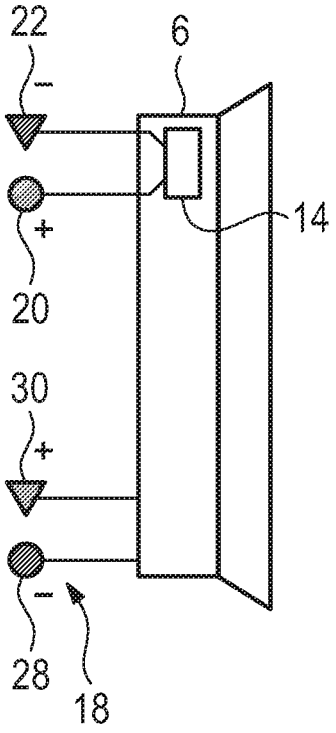
Figure 5A:
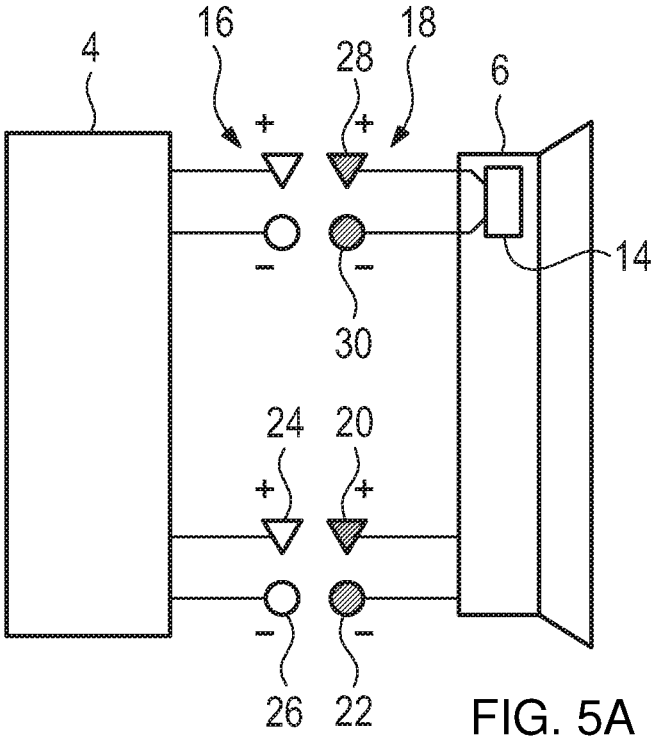
FIGS. 5A and 5B are schematic illustrations of a third variant of a hearing aid system.

In the case of the one receiver type in FIGS. 3A, 4A and 5A, the first signal contact 20 is a positive pole and can be connected to the first pole 24, which is also a positive pole. The second signal contact 22 is a negative pole, and can be connected to the second pole 26, which is also a negative pole. In the case of the other receiver type illustrated in FIGS. 3B, 4B and 5B, the first signal contact 20 is also a positive pole, but unlike in FIGS. 3A, 4A and 5A, can be connected to the second pole 26, which is now a negative pole. The second signal contact 22 is then a negative pole, and can be connected to the first pole 24, which is now a positive pole. The receivers 6 of FIGS. 3A and 3B are thus constructed with mutual polarity reversal. The two receivers 6 shown in FIGS. 3A and 3B together also constitute a receiver set. Both also apply correspondingly to the two receivers 6 of FIGS. 4A and 4B and to the two receivers 6 of FIGS. 5A and 5B.

The variant of FIGS. 3A, 3B is now distinguished in that the electrical input signal 104 is supplied to the receiver 6 through the signal contacts 20, 22, and that the sensor 14 is disposed outside the receiver 6 and independently thereof, in this case as a part of the hearing device 4. The polarity reversal is thus realized in that the transmission of the input signal 104 to the receiver 6 is configured with polarity reversal, so that then, as a result of the principle, the secondary signal 112 that is generated by the receiver 6 of the first receiver type in FIG. 3A has an opposite arithmetic sign in comparison with the secondary signal 112 that is generated by a receiver 6 of the second receiver type in FIG. 3B. The phase difference for identification of the receiver 6 is thus generated during the transfer of the input signal 104 to the receiver 6, and hence at the beginning of the transfer path.

In the second variant in FIGS. 4A, 4B, in contrast, the receivers 6 are not themselves of reverse polarity with respect to the input signal 104, but rather the sensors 14 on the two sides of the hearing aid system 2. The respective sensor 14 is integrated in this case into the respective receiver 6, and is permanently connected to it, forming with it, as shown, an inseparable assembly. The sensor signal 114, and not the input signal 104, is now transferred through the signal contacts 20, 22. The phase difference for identification of the receiver 6 is thus generated at the generation of the sensor signal 114, or more precisely at the transfer of the sensor signal 114 to the control unit 10, i.e. at the end of the transfer path. The input signal 104 is transferred to the receiver 6 separately over an additional signal line with, accordingly, two additional signal contacts 28, 30. These signal contacts 28, 30 for the input signal 104 are then not of reverse polarity in different receiver types. In terms of the input signal 104, different receiver types are thus always connected with the correct phase, and in particular, also, always connected with the correct phase independently of the side. Altogether the receiver 6, in particular its signal interface 18, in FIGS. 4A, 4B, thus includes four signal contacts 20, 22, 28, 30, two signal contacts 28, 30 for the input signal 104 and two further signal contacts 20, 22, for the sensor signal 114.

Figure 5B:
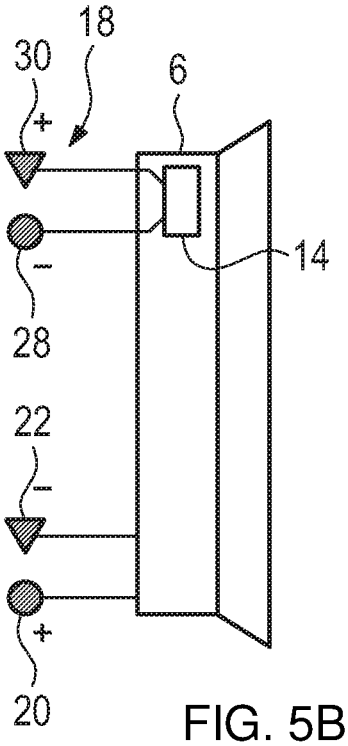

FIGS. 5A and 5B now show a combination of the two variants of FIGS. 3A, 3B and 4A, 4B. In FIGS. 5A, 5B the two receiver types are constructed with polarity reversal with respect to the input signal 104, i.e. are constructed like in the variant of FIGS. 3A and 3B. In contrast to the variant of FIGS. 3A, 3B, however, in the variant of FIGS. 5A, 5B the sensor 14 is in each case integrated into the receiver 6, like in the variant of FIGS. 4A, 4B. In terms of the sensor signal 114, however, the receiver types of the variant according to FIGS. 5A, 5B are not constructed with polarity reversal, but rather always have the correct phase. The variant of FIGS. 5A, 5B is thus based on the variant of FIGS. 3A, 3B, wherein the sensor 14 is now integrated into the respective receiver 6.

Any signal can, in principle, be used as the input signal 104, for example an electrical audio signal can also be used as an alternative or in addition to the amplified microphone signal 102. In a variant, not illustrated, a start signal which is played when switching on, i.e. when operation of the hearing aid system 4 begins and is, for example, generated by the control unit 10 or is stored in it, is used as the input signal 104. An identification of the receiver 6 thus takes place even before an actual hearing operation.

In a variant, also not shown, the receiver 6 is identified in the course of an open-loop gain measurement of the hearing aid system 4. This open-loop gain measurement is also referred to as a calibration operating mode and, put more precisely, is a calibration operating mode for calibration of a maximum amplification of the hearing device 4, which usually depends on the respective, actually present and possibly changing environmental conditions. The hearing aid system 2 in this case thus includes an amplification control which is calibrated in the calibration operating mode in that a test signal is used as the input signal 104, whereby a calibration signal is generated in order to adjust the maximum amplification of the hearing aid system 4. The calibration signal is in particular used in combination with the test signal to determine the transfer function from the receiver 6 of the hearing aid system 4 to the eardrum of the user and, depending on that, to adjust the maximum amplification. The calibration signal is then used at the same time as the sensor signal 114. Alternatively or in addition, the described measurement takes place adaptively in ongoing operation and not, or not exclusively, in the calibration operating mode.

In a variant, not illustrated, in addition to the identification of the receiver 6 by the phase measurement described, a power class of the receiver 6 is also determined by an impedance measurement or by an amplitude measurement or both. The power class is, for example, defined by an electrical resistance of the receiver 6, i.e. an electrical resistor is integrated into the receiver 6, similarly, for example, to the sensor 4 in FIGS. 4A, 4B. The resistor has a specific resistance value which is assigned to a specific power class, so that the power class of the receiver 6 is determined through a measurement of the resistance.

The following is a summary list of reference numerals and the corresponding structure used in the above description of the invention.

LIST OF REFERENCE SIGNS

2 Hearing aid system
4 Hearing device
6 Receiver
8 Connection
10 Control unit
12 Microphone
14 Sensor
16 Receiver connection
18 Signal interface
20, 22 Signal contact
24, 26 Pole
28, 30 Signal contact
100 Sound signal
102 Microphone signal
104 Input signal
106 Sound signal
108 Magnetic field
110 Primary signal
112 Secondary signal
114 Sensor signal
T Transfer function

The invention claimed is:

1. A method for the identification of a receiver belonging to one of a plurality of receiver types in a hearing aid system, the method comprising the following steps:

supplying an electrical input signal to the receiver for sound output;

defining the input signal as a primary signal, and generating a secondary signal in dependence on the input signal based on the sound output;

using a sensor to capture the secondary signal and using the sensor to generate an electrical sensor signal in dependence on the secondary signal;

carrying out a phase measurement by determining a phase difference between the input signal and the sensor signal;

identifying the receiver by assigning the receiver to one of the plurality of receiver types based on the phase difference;

providing the receiver with two signal contacts;

using the signal contacts to connect the receiver with reverse-polarity protection to a hearing device of the hearing aid system; and providing a difference between a first receiver type and a second receiver type of the plurality of receiver types by configuring the receiver types with mutually opposed reverse-polarity protection, for generating two phase differences by a receiver of the first receiver type and by a receiver of the second receiver type differing by 180°.

2. The method according to claim 1, which further comprises:

providing the hearing aid system as a binaural hearing aid system;

designating a first of the plurality of receiver types as a left-hand receiver provided for use on a left-hand side of the hearing aid system;

designating a second of the plurality of receiver types as a right-hand receiver provided for use on a right-hand side of the hearing aid system; and carrying out a side recognition by identifying the receiver as a left-hand receiver or as a right-hand receiver based on the phase difference.

3. The method according to claim 1, which further comprises:

supplying the electrical input signal to the receiver through the signal contacts; and locating the sensor outside the receiver and independently of the receiver.

4. The method according to claim 1, which further comprises:

integrating the sensor into the receiver and permanently connecting the sensor to the receiver; and transferring the sensor signal through the signal contacts.

5. The method according to claim 1, which further comprises:

providing the secondary signal as a sound signal generated by the receiver during the sound output; and providing the sensor as a microphone picking up the sound signal.

6. The method according to claim 1, which further comprises:

providing the secondary signal as a magnetic field generated by the receiver during the sound output; and providing the sensor is a magnetic field sensor measuring the magnetic field.

7. The method according to claim 1, which further comprises:

providing the secondary signal as a vibration generated by the receiver during the sound output; and providing the sensor as a vibration sensor or an acceleration sensor picking up the vibration.

8. The method according to claim 1, which further comprises providing the electrical input signal as a start signal being played when the hearing aid system is switched on.

9. The method according to claim 1, which further comprises:

providing an amplification control of the hearing aid system being calibrated in a calibration operating mode by using a test signal as the input signal, and generating a calibration signal to adjust a maximum amplification of the hearing aid system; and using the calibration signal concurrently as the sensor signal.

10. The method according to claim 1, which further comprises providing the receiver with a power class being determined through an additional amplitude measurement with the sensor.

11. The method according to claim 10, which further comprises carrying out the amplitude measurement simultaneously with the phase measurement.

12. The method according to claim 1, which further comprises providing the receiver with a power class being determined through an additional impedance measurement.

13. The method according to claim 12, which further comprises carrying out the impedance measurement simultaneously with the phase measurement.

14. The method according to claim 1, which further comprises carrying out the phase measurement at a frequency of at most 500 Hz.

15. A hearing aid system, comprising:

a hearing device;

a receiver belonging to one of a plurality of receiver types to be identified, said receiver having two signal contacts for connecting said receiver to said hearing device with reverse-polarity protection;

said plurality of receiver types including different first and second receiver types configured with mutually opposed reverse-polarity protection, for generating two phase differences by a receiver of said first receiver type and by a receiver of said second receiver type differing by 180°;

said receiver receiving an electrical input signal as a primary signal for sound output and generating a secondary signal in dependence on the input signal based on the sound output;

a sensor capturing the secondary signal, said sensor generating an electrical sensor signal in dependence on the secondary signal; and a control unit carrying out a phase measurement by determining a phase difference between the input signal and the sensor signal for identifying said receiver by assigning said receiver to one of said plurality of receiver types based on the phase difference.

16. The hearing aid system according to claim 15, wherein said receiver is one of two receivers to be used for different respective ears of a user.

17. A receiver set, comprising two receivers according to claim 15.

* * * * *